US005566937A

United States Patent [19]

Lorhpipat et al.

[11] Patent Number: 5,566,937

[45] Date of Patent: Oct. 22, 1996

[54] TAKRAW BALLS

[75] Inventors: Boonchai Lorhpipat; Boonsakdi Lorpipatana, both of Bangkok, Thailand

[73] Assignee: Satian Industries Co., Ltd., Naknonpathom, Thailand

[21] Appl. No.: 314,807

[22] Filed: Sep. 29, 1994

[30] Foreign Application Priority Data

Apr. 14, 1994 [GB] United Kingdom ..... 9407421

[51] Int. Cl.[6] ..... A63B 39/00

[52] U.S. Cl. ..... 273/58 B; 273/58 D; 446/107; 446/120

[58] Field of Search ..... 273/58 B, 58 D, 273/58 BA, 327, 428, 58 K, 58 R; 446/111, 107, 120; 428/11

[56] References Cited

U.S. PATENT DOCUMENTS 3,603,025 9/1971 Heubl ..... 446/111 X 4,131,276 12/1978 Judkins ..... 273/58 C 4,813,674 3/1989 Lorhpipat ..... 273/58 B 5,224,959 7/1993 Kasper ..... 273/58 B

FOREIGN PATENT DOCUMENTS 2196861 5/1988 United Kingdom .

*Primary Examiner*—George J. Marlo

*Attorney, Agent, or Firm*—Kilpatrick & Cody; John S. Pratt; Richard A. Clegg

[57] ABSTRACT

A takraw ball having a relatively soft, or elastically deformable, surface and conventional rebound characteristics. The takraw ball may be woven from composite strips, one component of which is elastically deformable material and forms the ball surface and the another component of which is a springy material. The elastically deformable material and the springy material are selected to produce a desired rebound characteristic. The strips have a wide variety of shapes and compositions. In an alternative embodiment the springy material component forms the ball surface and the elastically deformable material provides reinforcement for the strip.

34 Claims, 6 Drawing Sheets

FIG.10
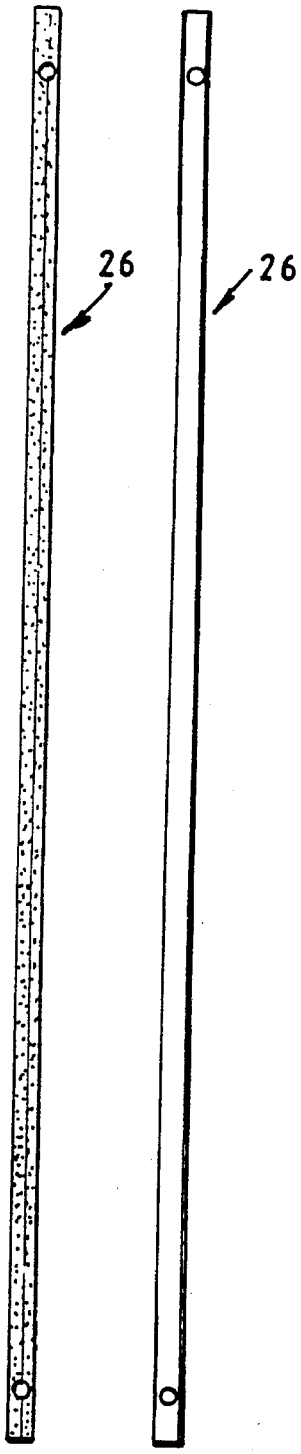
FIG. 9
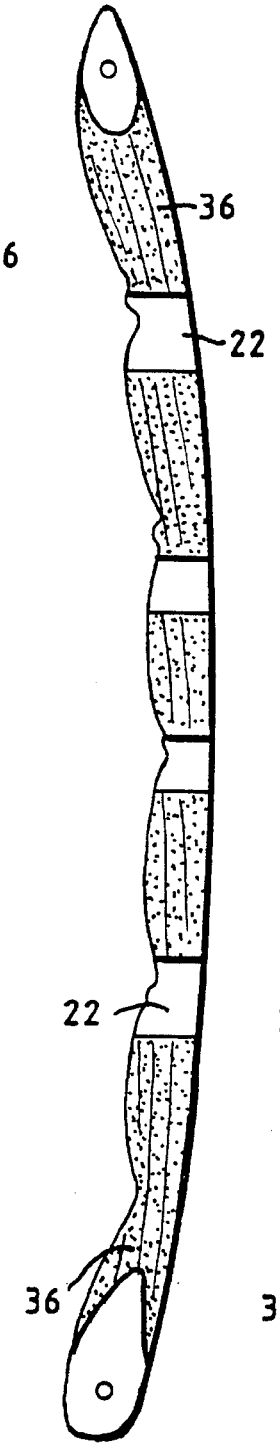
FIG.12
FIG.13
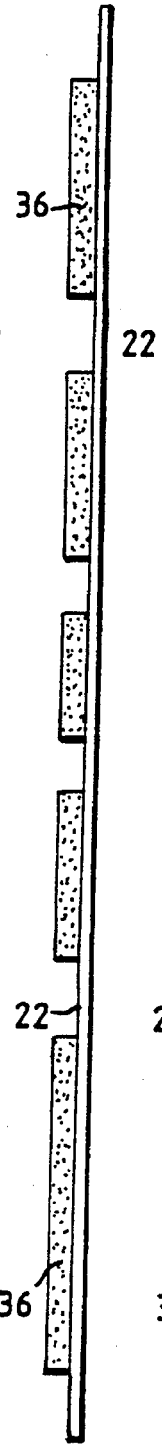
FIG.14
FIG.15
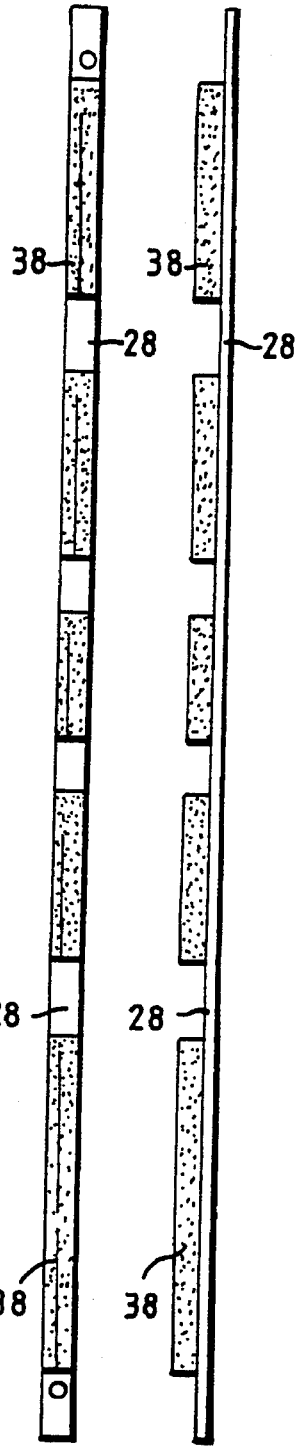

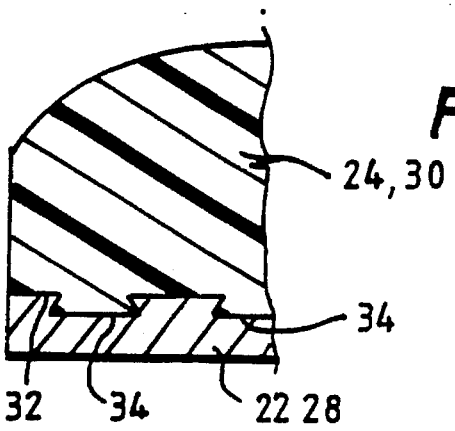
FIG. 11
FIG. 16
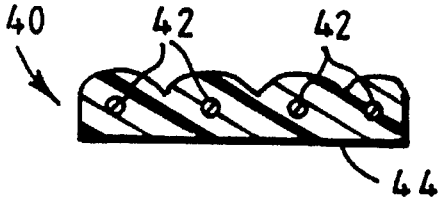
FIG. 17
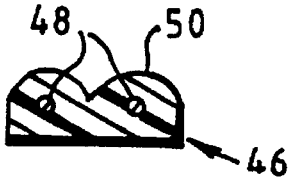
FIG. 18
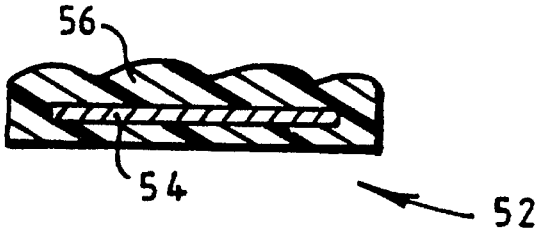
FIG. 19
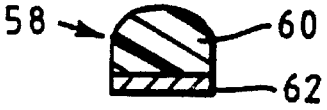
FIG. 21
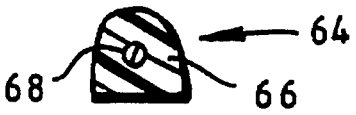
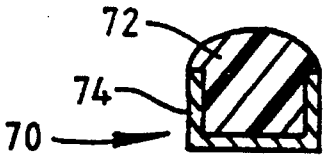
FIG. 22

TAKRAW BALLS

BACKGROUND OF THE INVENTION

This invention relates to takraw balls and it particularly relates to an improved takraw ball with regard to playability and safety.

Sepak Takraw is played by opposing teams passing a takraw ball across a chest-high net using feet, knees, head, shoulders etc., i.e. every part of the body except the player's hands and arms. The object of the game is to ground the ball in the opposing team's court; the rules of the game are similar to volleyball. Another form of takraw is hoop takraw, only one team plays at a time and the players co-operate to get the ball into a vertically orientated hoop some 5 meters above the ground.

United Kingdom Patent Specification No. 2,196,861 (Lorhpipat) describes the manufacture of traditional takraw balls by conventionally weaving split rattan strips into a spherical basket and the manufacture of takraw balls by forming strips of plastics material into interwoven hoops. As shown by FIG. 1, a takraw ball 1 has a spherical woven structure with a regular array of openings 2.

It is an essential characteristic of the takraw ball for it to be as inelastic as possible; this is to obtain the maximum energy transfer when the ball is struck so that the ball's flight or trajectory is as far, fast or high as possible. A takraw ball's bounce characteristic is much closer to the essentially inelastic collision between billiard balls than the elastic collision between a squash ball and racket. The woven structure of a takraw ball modifies its bounce characteristic, there is a small amount of relative movement between the strips that contributes to the essential "feel" of the ball, without which the ball is not a takraw ball.

A takraw ball may be defined by the below listed parameters:

weight=100 to 250 gm circumference=380 to 460 mm bounce=a first rebound of between 100 and 150 cm when dropped in free fall from a height of 330 cm.

A competition sepak takraw ball must have the following parameters:

weight=170 to 180 gm circumference=420 to 440 mm bounce=a first rebound of between 130 to 135 cm and within a solid angle of 15° when dropped in free fall from a height of 330 cm.

The drawback of both the conventional rattan takraw ball and the above-described plastics takraw ball is that their essential inelasticity makes them hard and playing takraw can be quite painful; especially for the novice. Clearly, this limits the popularity of the game as a participation sport. In addition, the hardness of the takraw ball can be dangerous. In conventional balls the rattan can unexpectedly break or splinter and cut the skin of a player. Similarly, the plastics takraw ball can break. Takraw can be played on almost any surface, not just the gymnasium floor of competition events, and some surfaces, such as concrete, can rapidly abrade/wear the surface of both types of ball; it is this that can lead to ball breakage.

U.S. Pat. No. 5,224,959 (Kasper) discloses a woven skeleton ball which is limited to "a plurality of loops woven together into a hollow spheroidal skeletal grid, said ball having an outer surface which is predominantly open space and thus making said ball suitable for allowing a user's fingers to pass through said surface and grip said loops" (see column 7 line 66 to column 8 line 2). This skeleton ball is clearly not a takraw ball, which is stated to have "a predominantly closed smooth surface with relatively few small openings" (see column 2, lines 37 to 39). It is evident that this skeleton ball cannot function or be used as a takraw ball. Its deformability or shape changing characteristic means that it cannot have an inelastic bounce characteristic. It probably has no bounce characteristic at all; whereas a takraw ball has to restore its original spherical shape after each collision.

U.S. Pat. No. 5,224,959 discloses composite materials, see FIGS. 3C and 3D and the related description at column 5 lines 8 to 27; however, there is no disclosure of the skeleton ball being bounceable, let alone selection of materials to produce a given bounce characteristic as required by the present invention.

It is one object of the present invention to provide a softer takraw ball whilst retaining the ball's essential characteristics. Conventional takraw balls are traditionally treated with coconut oil both to prevent the ball from rotting and to reduce the brittleness of the rattan, i.e. to make it softer and more playable. Experiments to simply make a plastics takraw from softer material were unsuccessful because the necessary bounce characteristic could not be achieved and the ball would not retain its woven structure when played, strips moved and overlapped one another.

Another object of the present invention is to provide a safer takraw ball.

SUMMARY OF THE INVENTION

According to the present invention, a takraw ball is woven from strips at least a majority of which are composite strips having one component part of soft material and another component part of springy material; the soft material and the springy material being selected to produce a given bounce characteristic. By springy is meant a material that is essentially stiff or rigid but also resilient such that, if deflected under applied load it will return to its original shape or position.

According to an embodiment of the present invention, the composite strip is formed and arranged such that, when woven into a ball, at least the exposed outer surface of the ball is constituted by said soft part. Surprisingly, a takraw ball in accordance with this embodiment of the present invention can have a significantly softer outer surface than known takraw balls and still have essentially the same bounce characteristics; such a ball will have the surface softness of, for example, a soccer ball and yet be fully playable.

According to a further embodiment of the present invention, the soft part of the composite strip is continuous.

According to another embodiment of the present invention, the soft part of the composite strip is discontinuous, being limited to only those areas of the composite strip that, when woven, will constitute the exposed outer surface of the ball. The effect of this is that the soft part of the composite strip will not occur under woven intersections. This permits higher coefficient of friction soft material to be used; the relative movement at woven intersections that occurs when the ball bounces or is struck will be between the low coefficient of friction springy parts.

Additionally or alternatively, the soft component part can provide a safety surface layer, guarding a player against the ball becoming damaged; the springy component part may be brittle and liable to break or fracture and the elastic surface can prevent sharp spring parts from protruding through the surface.

According to yet another embodiment of the present invention, the soft part of the composite strip is in the form of a backing layer for a springy outer layer or is in the form of a core within a springy body. This produces a conventionally hard takraw ball but the backing layer or core, being soft or flexible, holds the strip together should the springy outer layer or body fracture or break.

The composite strip generally takes two different forms:

a continuous or discontinuous outer layer of soft material with a springy backing; or a springy core embedded in a soft body.

Examples of suitable springy materials are:

spring metal, nylon fibre, glass fibre, carbon fibre, engineering plastics.

Examples of suitable soft materials are:

rubber, elastomer, thermoplastics elastomer (TPE), polyurethane, silicon rubber.

A takraw ball could be manufactured from composite strips in accordance with the present invention and having the general form described in United Kingdom Patent Specification No. 2196861. Alternatively, a takraw ball could be conventionally woven from composite strips of synthetic rattan in accordance with the present invention.

BRIEF DESCRIPTION OF THE DRAWINGS

The above and other features of the present invention are illustrated, by way of example, by the Drawings, wherein:

FIGS. 9 and 10 are, respectively, a plan and an underplan of the composite centre hoop strip of FIG. 7;

FIG. 11 is a detail cross-section of an alternative composite side hoop strip;

FIG. 12 is a plan of a discontinuous outer layer composite side hoop strip in accordance with another embodiment of the present invention;

FIG. 13 is a side elevation of the composite side hoop strip of FIG. 12;

FIG. 14 is a plan of a discontinuous composite centre hoop strip in accordance with the another embodiment;

FIG. 15 is a side elevation of the composite centre hoop strip of FIG. 14;

FIG. 16 is a cross-section of a second form of composite side hoop strip;

FIG. 17 is a cross-section of a second form of composite centre hoop strip;

FIG. 18 is a cross-section of a third form of composite side hoop strip;

FIG. 19 is a cross-section of a composite synthetic rattan strip in accordance with a further embodiment of the present invention;

FIG. 21 is a cross-section of a second form of composite synthetic rattan strip;

FIG. 22 is a cross-section of a third form of composite synthetic rattan strip; and, FIG. 23 is a graph of free fall first-bounce height of various takraw balls.

Figure 3:
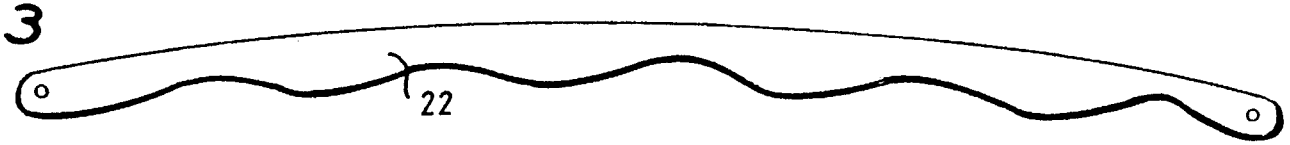
FIG. 3 is a plan of a spring for the composite hoop side strip of FIG. 2.
Figure 2:
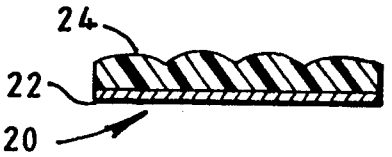
FIG. 2 is a cross-section of a composite side hoop strip in accordance with one embodiment of the present invention.

As shown by FIG. 2, a composite side hoop strip 20 comprises a thin, flat springy backing 22 of, for example an engineering plastic, and a soft outer layer 24, of for example TPE; as can be seen the spring extends over the whole width of the side strip. The plan shape of the springy backing 22 is shown in FIG. 3. The side hoop strip 20 is formed by suspending a spring in a mould and then injecting the outer layer material onto the spring; the final shape of the thus formed composite side hoop strip being shown in FIGS. 4, 5 and 6. The spring and outer layer materials are compatible so that they will bond together during the injection moulding process.

Figure 8:
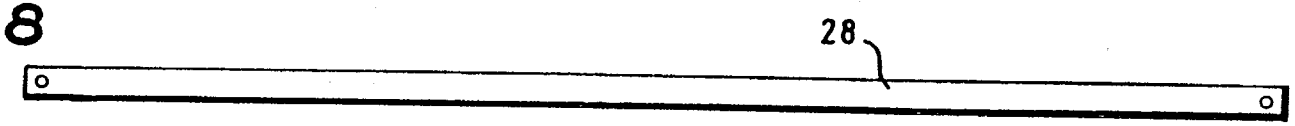
FIG. 8 is a plan of a spring for the centre hoop strip of FIG. 7.
Figure 7:
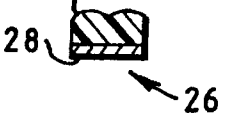
FIG. 7 is a cross-section of a composite centre hoop strip for the one embodiment.

As shown by FIG. 7 a composite centre strip 26 comprises a thin, fiat springy backing 28 having a soft outer layer 30. As can be seen the springy backing 28 extends over the whole width of the centre strip 26. The plan shape of the springy backing 28 is shown in FIG. 8. The spring is made from the same material as side strip backing 22. The outer layer 30 is of the same material as side strip outer layer 24 and the centre strip is also injection moulded to have the final shape shown in FIGS. 9 and 10.

Figure 1:
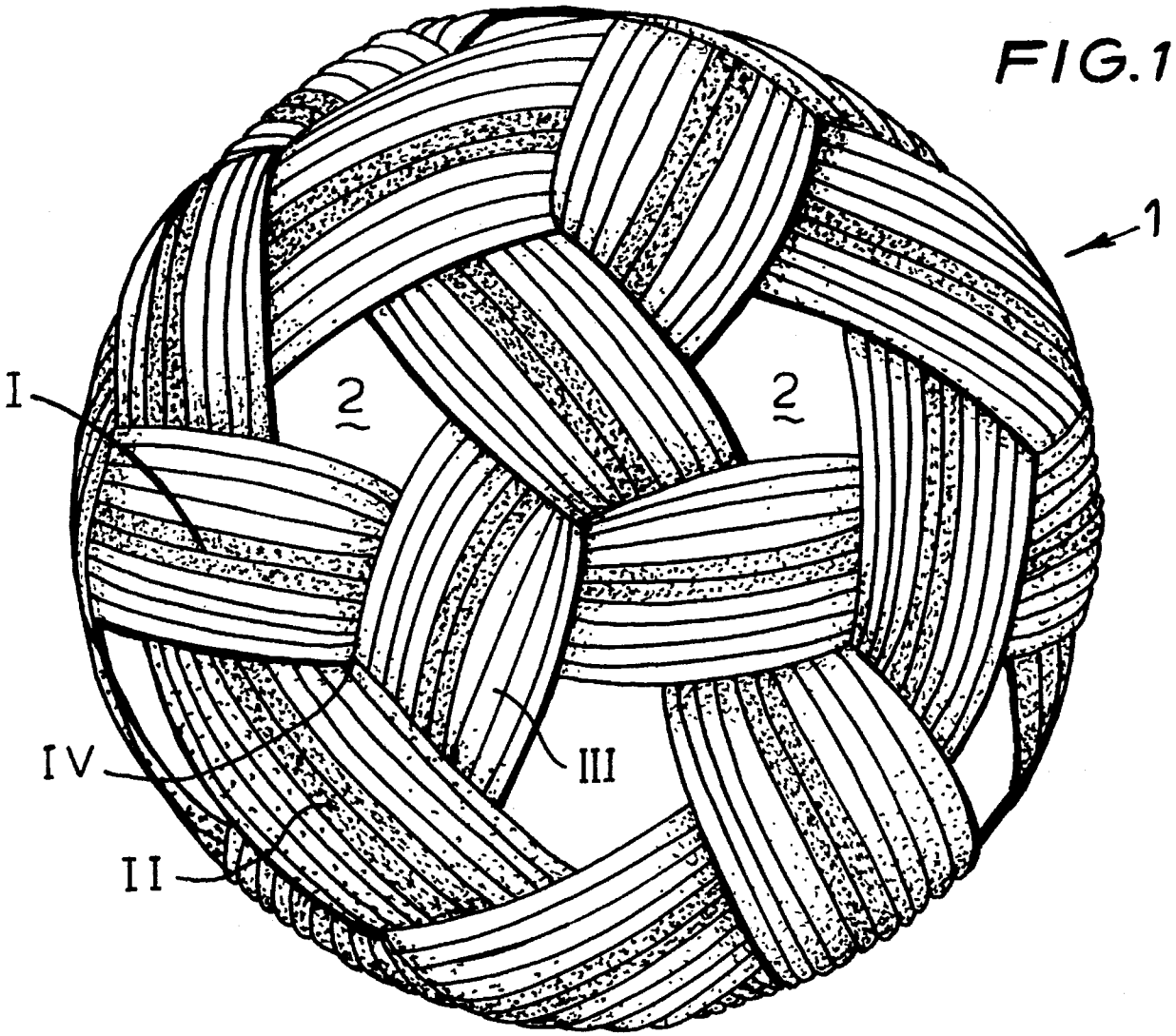
FIG. 1 is a prior art takraw ball;p

Side strips 20 and centre strips 26 are then woven to form a takraw ball in the same manner as described in United Kingdom Patent Specification No. 2196861. The resulting takraw ball is similar in appearance to the takraw ball shown in FIG. 1 but has a soft outer covering, formed by strip layers 24 and 30. This soft outer surface is considerably softer than the surface of previous plastic takraw balls and is thus easier to play with. In addition the softer outer layers enable interwoven bands I, II and III to fit more closely and tightly at a cross-over IV (see FIG. 1); further improving the spherical shape of the ball.

FIG. 11 illustrates an alternative to bonding between the composite materials, the upper surface 32 of the springy backings, 22 or 28, is shaped, such as by undercutting 34, to enable the outer layers, 24 or 30, to mechanically key with the backings.

FIGS. 12 to 15 illustrate an alternative embodiment wherein the soft side and centre hoop strip outer layers 36, 38 are discontinuous. The outer layers 36 are limited to five specially shaped areas on each backing strip 22, 28, as indicated by stippling in the figures. The effect of this is that, unlike the embodiment of FIGS. 2 to 11 where the outer layers are continuous and the intersections of the woven ball effectively have four layers (soft, springy, soft, springy), the meeting surfaces at woven intersections are constituted solely by the backing strips. This greatly extends the range of suitable soft materials; as high coefficient of friction, more abrasion-resistant or softer materials can be chosen. With lower coefficient of friction springy backing material enabling the strips to ready slide over one another at woven intersections.

Figure 4:
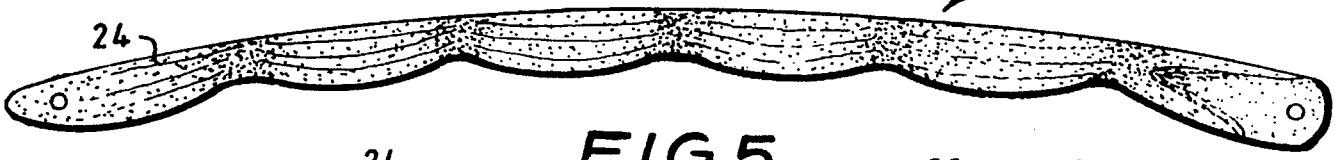
FIGS. 4 to 6 are, respectively, a plan, a side elevation and an under plan of the composite side hoop strip of FIG. 2.
Figure 5:
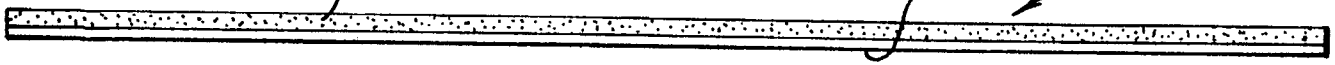
Figure 6:
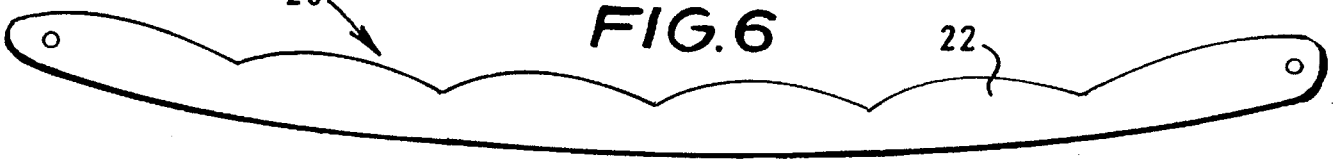

FIG. 16 shows an alternative form of composite side strip 40 to comprise four steel wire spring cores 42 embedded in a soft body 44. The side strip 40 is formed by suspending spring cores in a mould and then injecting the body material about the spring cores; the final shape of the thus formed composite side strip again being essentially the same as shown in FIGS. 4, 5 and 6. In this case it may not be necessary to bond the spring cores and the body; the cores may simply be trapped within the body.

FIG. 17 shows an alternative form of composite centre strip 46 to comprise two steel wire spring cores 48 embedded in a soft body 50 and it is formed by co-extruding the body about the spring cores; again the final shape of the thus formed composite centre strip is the same as that shown by FIGS. 10 and 11. Again, it may not be necessary to bond the spring cores and the body; the extrusion process may tightly shrink the body onto the spring cores to firmly hold them in place. The surface of the spring cores could be roughened to improve the mechanical key between core and body.

FIG. 18 shows another variant 52 of the composite side hoop strip of FIG. 2; in this variant, the spring 54 is a strip of spring steel and is wholly embedded as a core within a body 56 so that the spring can be mechanically retained within the body. The plan shape of the spring strip can vary from a simple curve-sided bow to more complex shapes. An equivalent composite centre hoop strip (not shown) could be provided.

It is, of course, possible to weave takraw balls from different combinations of side and centre hoop strips; for example by combining side hoop strips 20 with centre hoop strips 46. It is also possible to use different composite materials for the side and centre hoop strips.

Figure 20:
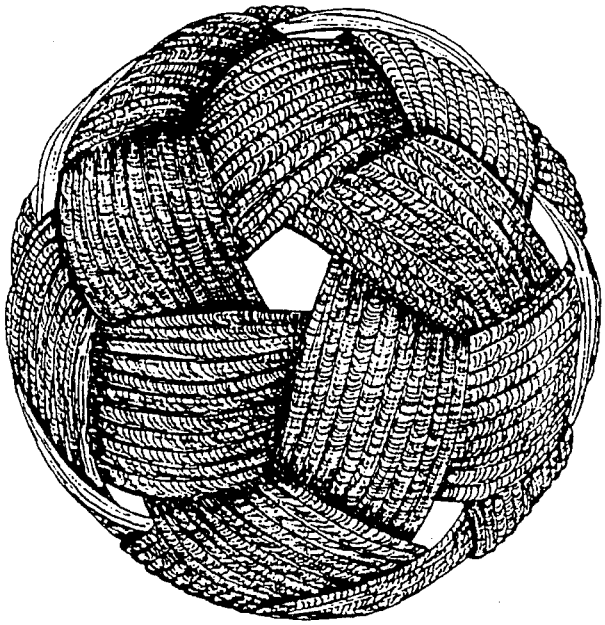
FIG. 20 is a view of a takraw ball conventionally woven from the synthetic strip of FIG. 19.

A synthetic rattan strip for the manufacture of conventionally woven takraw balls is shown by FIG. 19 to be a composite 58 of generally rectangular-like cross-section that has a soft outer layer 60 and a springy backing layer 62. The two layers are co-extruded and the materials are chosen so that they will bond together during the extrusion process. Alternatively, the upper surface of the backing layer could be shaped to mechanically key with the outer layer. The composite strip 58 is dimensionally the same as split rattan stalk; i.e. approximately 3 to 4 millimeters wide and thick. Lengths of this synthetic rattan strip can then be woven into a takraw ball in the conventional, traditional manner, to produce a takraw ball as shown in FIG. 20.

A takraw ball woven from this synthetic rattan material has all the advantages of a plastics takraw ball in consistency of performance etc, has the player friendly soft/safe outer covering and is a more accurate reproduction of a traditional takraw ball; thus making it especially suitable for playing takraw through the hoop. In addition, the deformability of the outer layer enables the ball to be woven into a more uniform, spherical shape.

FIG. 21 shows an alternative form of synthetic rattan strip 64, wherein a soft, outer body 66 is co-extruded about an inner core 68 of spring steel wire; in much the same manner as centre hoop strip 46.

FIG. 22 shows a further form of synthetic rattan strip 70, wherein a soft outer body 72 is moulded in a U-shaped channel section spring 74.

All the above described forms of synthetic rattan have a continuous outer body. It is equally possible to produce a synthetic rattan strip having a discontinuous outer body, such that there is only direct contact between springy backing layers at woven intersections.

As mentioned above, abrasion and wear of takraw balls leads to their breakage and the danger of hurting players. Wear indicators, for example a colour change, can be incorporated into the outer layer of any of the above composite strips to indicate when the ball has become dangerously worn.

Figure 23:
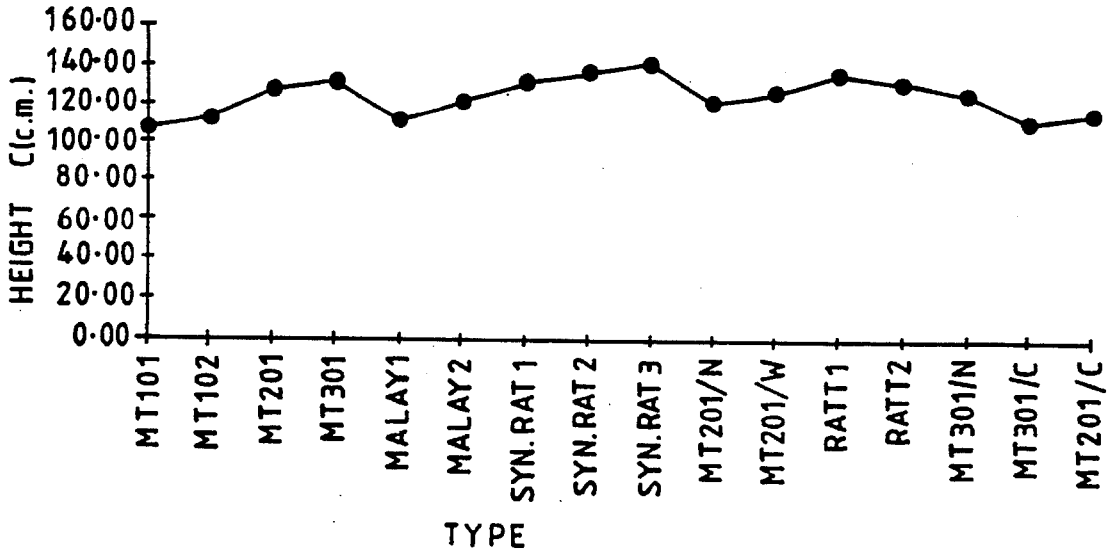
Figure 24:
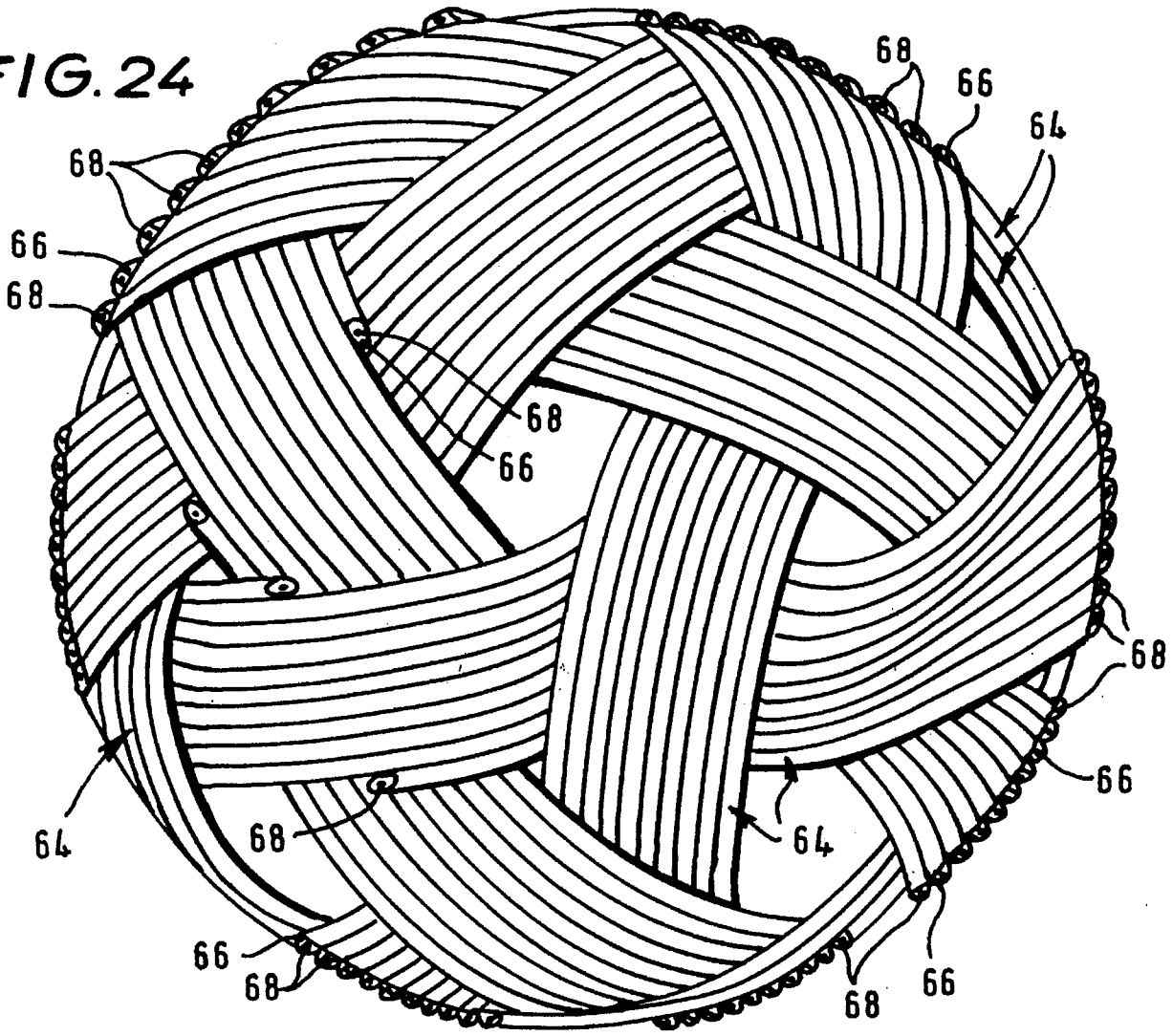

FIG. 23 is a graph of free fall first-rebounce height of prior art takraw balls and takraw balls in accordance with the present invention; tabulated below:

| TYPE | BOUNCE HEIGHT | MATERIAL | REMARKS |
|---|---|---|---|
| MT101 | 107.50 cm | Polyolefin Blend* | PRIOR ART |
| MT102 | 112.50 cm | Polyolefin Blend* | PRIOR ART |
| MT201 | 127.50 cm | Polyolefin Blend* | PRIOR ART |
| MT301 | 132.50 cm | Polyolefin Blend* | PRIOR ART |
| MALAY1 | 112.50 cm | Competitor's product | PRIOR ART |
| MALAY2 | 122.50 cm | Competitor's product | PRIOR ART |
| SYN.RAT1 | 132.50 cm | Polyolefin Blend* | PRIOR ART |
| SYN.RAT2 | 137.50 cm | Polyolefin Blend* | PRIOR ART |
| SYN.RAT3 | 142.50 cm | Polyolefin Blend* | PRIOR ART |
| MT201/N | 122.50 cm | Polyolefin/Nylon composite | INVENTION |
| MT201/W | 127.50 cm | wire-reinforced Polyolefin | INVENTION |
| RATT1 | 137.50 cm | NATURAL RATTAN | PRIOR ART |
| RATT2 | 132.50 cm | NATURAL RATTAN | PRIOR ART |
| MT301/N | 127.50 cm | Polyolefin/Nylon composite | INVENTION |
| MT301/C | 112.50 cm | Elastomer coated Polyolefin | INVENTION |
| MT201/C | 117.50 cm | Elastomer coated Polyolefin | INVENTION |

*"Polyolefin Blend" - this term is adopted to defined a homogeneous blend including polyethylene and polypropylene the proportions of which are varied to suit the particular application for which the takraw ball is to be used; from beginners, amateurs to professional competition players.

Of the takraw balls in accordance with the invention, types MT201/N and MT201/W are wire reinforced, composite synthetic rattan, conventionally woven takraw balls and types MT301/N, MT301/C and MT201/C are composite strip plastic takraw balls, from interwoven hoops. As can be seen, both types of composite strip takraw ball meet the bounce requirement.

In another, unillustrated application of the present invention the outer layer or body of the composite strip can be of the hard, springy polyolefin blend currently used for plastic takraw balls but the backing layer or core is of a soft material, such as nylon, and this acts to keep the ball together in the event that the outer layer or body breaks.

Although composite strips consisting of two separate parts have been described, it is the intention of this application to include a strip formed from a material that exhibits the characteristics of two different materials, soft and springy, within the definition of a composite strip.

We claim:

1. A takraw ball woven from strips wherein at least a majority of said strips comprise composite strips having one component part of softer material than any other component part and another component part of springier material than any other component part; the softer material and the springier material being chosen to produce a pre-selected bounce characteristic for the ball.

2. A takraw ball as claimed in claim 1, wherein each composite strip is formed and arranged such that, when woven into a ball, at least the exposed outer surface of the ball is constituted by the softer component part.

3. A takraw ball as claimed in claim 2, wherein the softer component part of the composite strip is continuous.

4. A takraw ball as claimed in claim 3, wherein the softer component part is a layer and the springier component part is a backing for the layer.

5. A takraw ball as claimed in claim 4, wherein the softer layer is moulded to the springier backing.

6. A takraw ball as claimed in claim 4, wherein the springier backing is mechanically keyed to the softer layer.

7. A takraw ball as claimed in claim 5 or claim 6, wherein the ball has a weight of between 100 and 250 gm., a circumference of between 380 and 460 cm. and a first rebound of between 100 and 150 cm. when dropped in free fall from a height of 330 cm.

8. A takraw ball as claimed in claim 5 or claim 6, wherein the softer material includes rubber, elastomer, thermoplastics elastomer, polyurethane or silicon rubber.

9. A takraw ball as claimed in claim 5 or claim 6, wherein the springier material includes spring metal, nylon fibre, glass fibre, carbon fibre, engineering plastics or a polyolefin blend.

10. A takraw ball as claimed in claim 1, wherein the softer component part is discontinuous, being limited to only those areas of the composite strip which, when woven, will constitute the exposed outer surface of the ball.

11. A takraw ball as claimed in claim 10, wherein the softer component part is a layer and the springier part is a backing for the layer.

12. A takraw ball as claimed in claim 11, wherein the softer layer is moulded to the springier backing.

13. A takraw ball as claimed in claim 12, wherein the springier backing is mechanically keyed to the softer layer.

14. A takraw ball as claimed in claim 12 or claim 13, wherein the ball has a weight of between 100 and 250 gm., a circumference of between 380 and 460 cm. and a first rebound of between 100 and 150 cm. when dropped in free fall from a height of 330 cm.

15. A takraw ball as claimed in claim 12 or claim 13, wherein the softer material includes rubber, elastomer, thermoplastics elastomer, polyurethane or silicon rubber.

16. A takraw ball as claimed in claim 12 or claim 13, wherein the springier material includes spring metal, nylon fibre, glass fibre, carbon fibre, engineering plastics or a polyolefin blend.

17. A takraw ball as claimed in claim 1, wherein the softer component part is a body of softer material and the springier component part comprises one or more cores of springier material embedded in the softer body.

18. A takraw ball as claimed in claim 17, wherein the softer body is moulded about the or all the springier cores.

19. A takraw ball as claimed in claim 18, wherein the softer body material and the springier core material are compatible such that they will bond to one another as the result of the moulding process.

20. A takraw ball as claimed in claim 17, wherein the or each springier core is mechanically retained by the softer body.

21. A takraw ball as claimed in any of claims 18, 19 or 20, wherein the ball has a weight of between 100 and 250 gm., a circumference of between 380 and 460 cm. and a first rebound of between 100 and 150 cm. when dropped in free fall from a height of 330 cm.

22. A takraw ball as claimed in any of claims 18, 19 or 20, wherein the softer material includes rubber, elastomer, thermoplastics elastomer, polyurethane or silicon rubber.

23. A takraw ball as claimed in any of claims 18, 19 or 20, wherein the springier material includes spring metal, nylon fibre, glass fibre, carbon fibre, engineering plastics or a polyolefin blend.

24. A takraw ball as claimed in claim 1, wherein the springier component part is in the form of an outer layer and the softer component part is in the form of a backing layer for the outer layer.

25. A takraw ball as claimed in claim 24, wherein the softer backing is moulded to the outer layer.

26. A takraw ball as claimed in claim 24, wherein the outer layer is mechanically keyed to the softer backing.

27. A takraw ball as claimed in claim 25 or claim 26, wherein the softer material includes rubber, elastomer, thermoplastics elastomer, polyurethane or silicon rubber.

28. A takraw ball as claimed in claim 25 or claim 26, wherein the springier material includes spring metal, nylon fibre, glass fibre, carbon fibre, engineering plastics or a polyolefin blend.

29. A takraw ball as claimed in claim 1, wherein springier component part is a body of springier material and the softer component part comprises one or more cores of softer material embedded in the springier body.

30. A takraw ball as claimed in claim 29, wherein the springier body is moulded about the or all the softer cores.

31. A takraw ball as claimed in claim 30, wherein the springier material and the softer material are compatible so that they will bond to one another as the result of the moulding process.

32. A takraw ball as claimed in claim 29, wherein the or each softer core is retained by the springier body.

33. A takraw ball as claimed in any of claims 30, 31 or 32, wherein the softer material includes rubber, elastomer, thermoplastics elastomer, polyurethane or silicon rubber.

34. A takraw ball as claimed in any of claims 30, 31 or 32, wherein the springier material includes spring metal, nylon fibre, glass fibre, carbon fibre, engineering plastics or a polyolefin blend.

* * * * *